US008007312B2

(12) United States Patent
Bower et al.

(10) Patent No.: US 8,007,312 B2
(45) Date of Patent: Aug. 30, 2011

(54) MODULAR TEST PLUG

(75) Inventors: Andrew Bower, Amherst, NH (US); Tim Masters, Boca Raton, FL (US); Roy Ball, Coral Springs, FL (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 12/841,447

(22) Filed: Jul. 22, 2010

(65) Prior Publication Data

US 2011/0028031 A1 Feb. 3, 2011

Related U.S. Application Data

(60) Provisional application No. 61/229,352, filed on Jul. 29, 2009.

(51) Int. Cl.
*H01R 13/60* (2006.01)

(52) U.S. Cl. ..... 439/540.1

(58) Field of Classification Search ..... 439/540.1, 439/188, 82; 200/51.1, 51.05; 361/727
See application file for complete search history.

(56) References Cited

U.S. PATENT DOCUMENTS

| | | | | |
|---|---|---|---|---|
| 5,533,907 | A | 7/1996 | Kozel et al. | |
| 5,601,442 | A | 2/1997 | Harting et al. | |
| 5,899,764 | A | 5/1999 | Harting et al. | |
| 6,315,580 | B1 * | 11/2001 | Hurtubise et al. | 439/82 |
| 7,271,357 | B2 | 9/2007 | Ostmeier | |
| 7,302,752 | B2 * | 12/2007 | Ball | 29/622 |
| 2005/0087433 | A1 * | 4/2005 | Yang et al. | 200/400 |

* cited by examiner

*Primary Examiner* — Jean Duverne
(74) *Attorney, Agent, or Firm* — Paul R. Katterle; Michael M. Rickin

(57) ABSTRACT

A modular test plug assembly is disclosed having a design which may be arranged in a plurality of different configurations. The test plug assembly includes a plurality of modules, having blades for insertion into a test switch assembly. The modules are positioned in a stacked arrangement and are secured together by end plates and a rod extending therebetween.

19 Claims, 10 Drawing Sheets

MODULAR TEST PLUG

CROSS-REFERENCE TO RELATED APPLICATION

This application claims the benefit of U.S. provisional patent application No. 61/229,352 filed on Jul. 29, 2009, which is hereby incorporated by reference in its entirety.

BACKGROUND

Protective relays can be found in any environment that uses electricity, from factories to power utilities. Relaying protection applications may include: motors, generators, transformers, station-buses, lines and circuits, system grounds, network systems, pilot wires, pilot channels, transmission lines, pilot relaying, backup, reclosing, synchronizing, load-shedding, frequency and many more.

Typically, relays operate in combination with current and potential transformers, which reduce the high currents and potentials to levels usable by the relays, meters and/or instruments. Relays are electrically connected to the system through a test switch terminal. Each test switch can be associated with one or more relays. It is generally necessary to short circuit the line and load terminals when a relay is removed from its case or when an adjacent test switch is opened. The test switch provides this necessary short circuit or bypass feature. Safety hazards and/or transformer damage could occur if this short circuit/bypass function is not performed.

An exemplary prior art test switch is shown in FIG. 1 and generally indicated by the numeral 10. The wide variety of test switches available allows for many types of applications. As is well known to those of ordinary skill in the art, these applications may include test switches with all potential switches, all current switches or some combination thereof.

Test switch 10 includes on its front face 10 switches 12*a* to 12*j* arranged in five (5) sets. In the embodiment shown in FIG. 1 for prior art test switch 10 there are two switches, namely switch 12*a* and 12*b*, which are associated with a respective current transformer (not shown). Test switch 10 also includes eight (8) potential switches, namely switches 12*c* and 12*d*, 12*e* and 12*f*, 12*g* and 12*h*, 12*i* and 12*j*.

One example of a pair of switches associated with a current transformer is shown in FIGS. 2*a* and 2*b*. The paired switches include a switch, such as switch 12*a* which has a shorting blade 14 and a switch such as switch 12*b* which does not have a shorting blade. The switch 12*a* with the shorting blade provides, when opened, the desired short circuit of the line and load terminals when that switch is opened. The switch 12*b* provides a current test jack 16.

On the rear face of test switch 10, twenty terminals are provided for connection to the relays. When test switch 10 is mounted in a switchboard panel (not shown) the switches 12*a* to 12*j* are accessible from the front of the panel and the terminals on the rear face are only accessible from the rear of the panel.

In-service test plugs, in cooperation with matching test switches are designed to be used while the relay is in-service in order to externally test potential, current, or other possible characteristics of the circuit. Use of the test plug does not effect the operation of the circuit itself or any associated protective equipment acting in conjunction with the circuit.

Prior art in-service type test plugs were restricted in their construction and developed exclusively for use with a specific matching switch configuration. Only a limited number of configurations are possible with the old devices, which rendered them useless in the future should new switches or switches with varying sizes be introduced.

Thus, there is a need in the art for an in-service test plug capable of being easily placed in multiple configurations.

SUMMARY OF THE INVENTION

According to one aspect of the present invention, a test plug assembly is provided for use with a test switch assembly. The test switch assembly is connected to one or more electrical circuits each of which have quantifiable characteristics when the circuit is in operation. The test switch assembly has one or more test switches each of which are associated with a respective one of the one or more electrical circuits. The test plug assembly includes one or more test plug modules positioned in a stacked arrangement, each of the one or more test plug modules adaptable for in-service measurement of the quantifiable characteristics of the associated one of the one or more electrical circuits when the circuit is in operation and the test plug assembly is mated with the test switch assembly, at least one of the one or more test plug modules having an outwardly extending, electrically conductive blade for receipt in that one of the one or more test switches associated with the in operation electrical circuit whose quantifiable characteristic is to be in-service measured by the at least one test plug module when the test plug assembly is mated with the test switch assembly. The blade is electrically connected within the one or more test plug modules to a first electrical connector adapted to receive an external electrical plug. Each of the one or more test plug modules further includes a first thru-hole. An end plate is positioned on each end of the plurality of modules. A handle is spaced from the one or more test plug modules, extends between the end plates and is secured thereto. A first rod extends between the end plates and is secured thereto. The first thru-hole of each of the one or more test plug modules is aligned when in the stacked arrangement. The first rod is received in the aligned first thru-holes.

According to another aspect of the present invention, a test plug assembly is disclosed for use with a test switch assembly that is connected to one or more electrical circuits where each of the electrical circuits have quantifiable characteristics when the circuit is in operation. The test switch assembly has one or more test switches each of which are associated with a respective one of the electrical circuits. The test plug assembly includes one or more test plug modules positioned in a stacked arrangement, each of the one or more test plug modules adaptable for in-service measurement of said quantifiable characteristics of said associated one of said one or more electrical circuits when said circuit is in operation and said test plug assembly is mated with said test switch assembly, at least one of the one or more test plug modules having an outwardly extending, electrically conductive blade for receipt in that one of said one or more test switches associated with said in operation electrical circuit whose quantifiable characteristic is to be in-service measured by said at least one test plug module when said test plug assembly is mated with said test switch assembly. The blade is electrically connected within the one or more test plug modules to at least one electrical connector adapted to receive an external electrical plug. An end plate is positioned on each end of the the one or more test plug modules. A handle is spaced from the the one or more test plug modules, and extends between the end plates and is secured thereto. Each of the one or more test plug modules includes, on a first side, a plurality of detents and on a second side, opposed from the first side, includes a plurality of raised features arranged to be received in the detents of an adjacent one of the one or more test plug modules when in the stacked arrangement.

A test plug assembly for use with a test switch assembly. The test switch assembly is connected to one or more electrical circuits. Each of the electrical circuits have quantifiable characteristics when the circuit is in operation. The test switch assembly includes one or more switches with each of the one or more switches associated with a respective one of the one or more electrical circuits. The test plug assembly includes two plates spaced apart from each other, a handle extending between the two plates and removably attached thereto; and a first rod spaced apart from the handle and extending between the two plates and removably attached thereto. The test plug assembly is adaptable for receiving one or more test plug modules positioned in a stacked arrangement in the test plug assembly between the two plates when the one or more test plug modules are received in the test plug assembly. Each of the one or more test plug modules are capable of in-service measurement of the quantifiable characteristics of the associated one of the one or more electrical circuits when the circuit is in operation and the test plug assembly with the received one or more test plug modules is mated with the test switch assembly. At least one of the one or more test plug modules have an outwardly extending, electrically conductive blade for receipt in that one of the one or more test switches associated with the in operation electrical circuit whose quantifiable characteristic is to be in-service measured by the at least one test plug module when the test plug assembly is mated with the test switch assembly. The blade is electrically connected within the at least one test plug module to a first electrical connector adapted to receive an external electrical plug. Each of the one or more test plug modules further includes a first thru-hole. The one or more of the test plug modules are received in the plug assembly by first removably detaching both the handle and the first rod from the two plates and then aligning the one or more test plug modules in the test plug assembly so that the first thru-hole of each of the one or more test plug modules is aligned when in the stacked arrangement so that first rod can be received in all of the aligned first thru-holes and be removably reattached to the two plates.

DETAILED DESCRIPTION OF THE INVENTION

Figure 1:
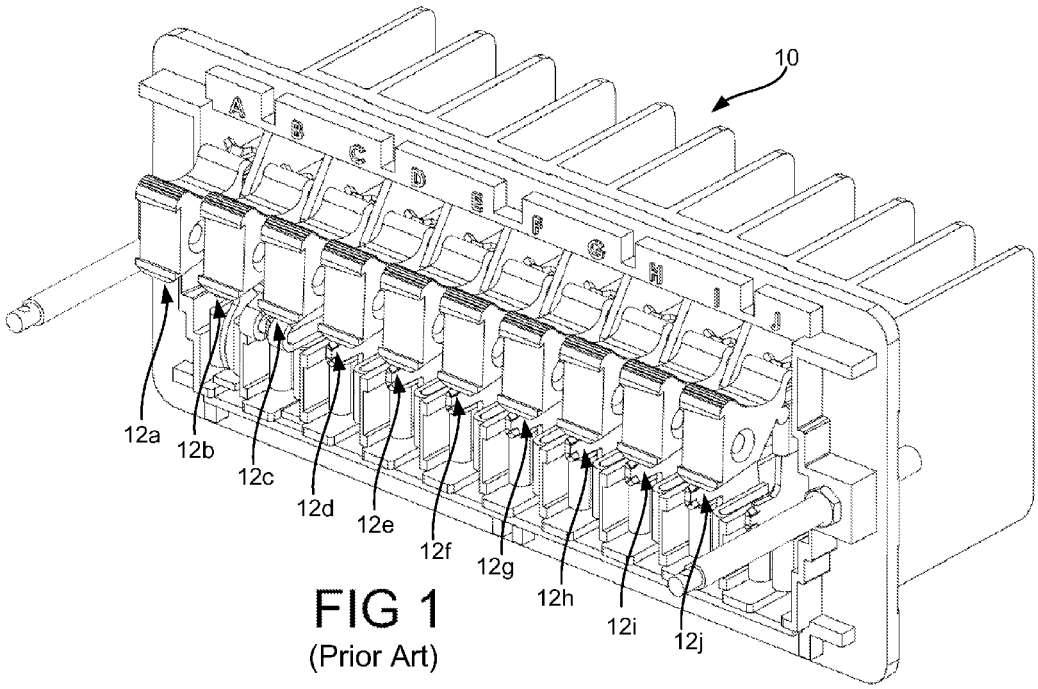
FIG 1 (Prior Art)
FIG. 1 is an isometric view of an exemplary prior art test switch, into which the test plug of the present invention is inserted.
Figure 2A:
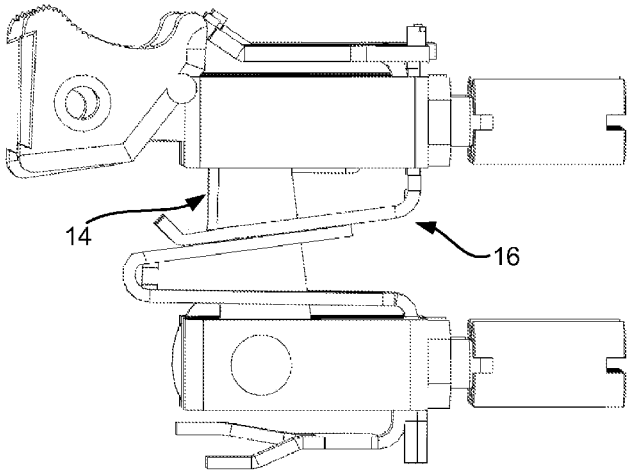
FIG 2a (Prior Art)
FIG. 2*a* is a right side view of a pair of individual prior art switches.
Figure 2B:
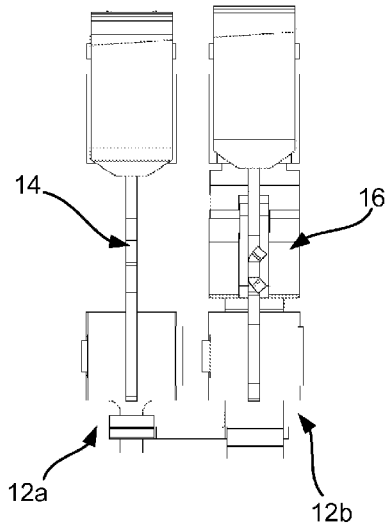
FIG 2b (Prior Art)
FIG. 2*b* is a front view of a pair of individual prior art switches.
Figure 3:
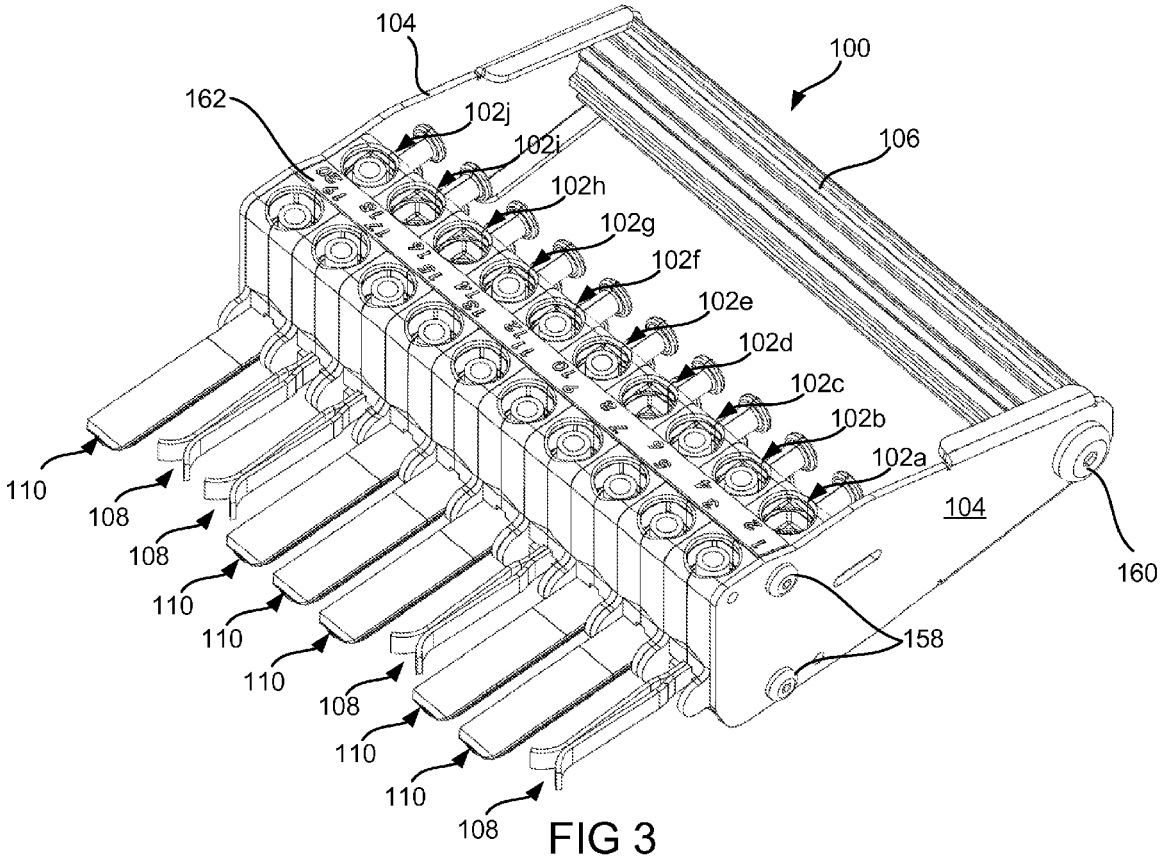
FIG. 3 is an isometric view of the test plug assembly according to the present invention.
Figure 4:
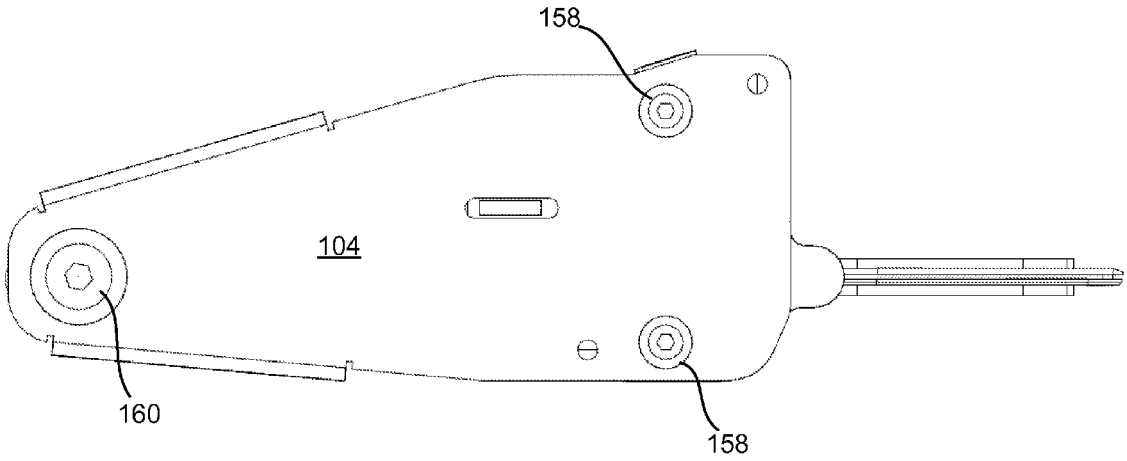
FIG. 4 is a right side view of the test plug assembly.

The in-service test plug assembly (hereinafter "test plug assembly") according to the present invention, provides a means to measure quantifiable characteristics of an electrical circuit while in operation. Accordingly, the test plug assembly provides an interface between knife-type and/or current jack switches and an external metering apparatus. As will be hereinafter discussed, the test plug assembly is modular in construction and consists of a plurality of stackable elements. Each individual element corresponds to a single switch unit and includes a plug electrically connected to banana-type jacks intended for use with test equipment leads. The housing for each element ensures that the electrical elements are insulated from one another while also providing structural interconnection features. The stacked elements are captured by a through-rod, and the device includes a convenient gripping handle.

With reference now to FIGS. 3-6, a test plug assembly according to the present invention is shown and generally indicated by the numeral 100. Test plug 100 generally includes a plurality of individual modules 102*a*-102*j* carried between a pair of opposed end plates 104. A handle 106 spans between end plates 104 at a location spaced from individual modules 102.

As can be seen from the figures, two different module types are shown. Modules 102*a*, 102*d*, 102*h* and 102*i* include a blade 108 having a generally elongated "Y" shape and modules 102*b*, 102*c*, 102*e*, 102*f*, 102*g* and 102*j* include a blade 110 having a generally elongated flattened shape. It should be appreciated however that any number of modules may be used in the test plug assembly of the present invention. Specifically, as will be discussed below in greater detail, because the test plug assembly is modular and the modules are interchangeable, various module types may be interchanged easily.

Figure 7:
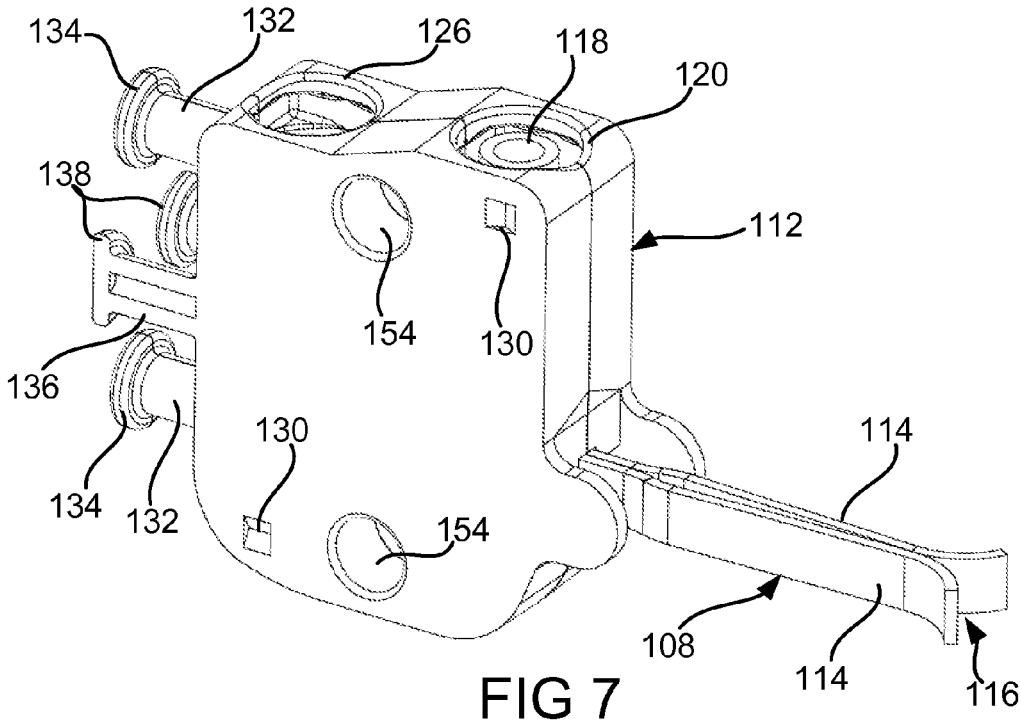
FIG. 7 is a front and right side elevated view of a first module type.
Figure 8:
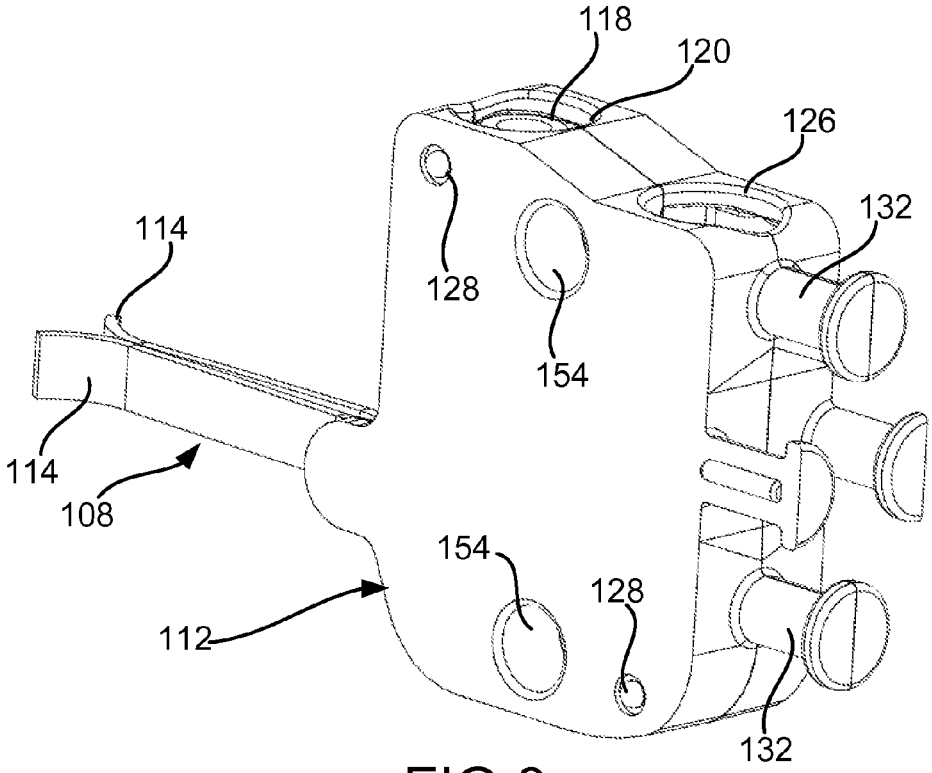
FIG. 8 is a rear and left side elevated view of the module of FIG. 7.
Figure 9:
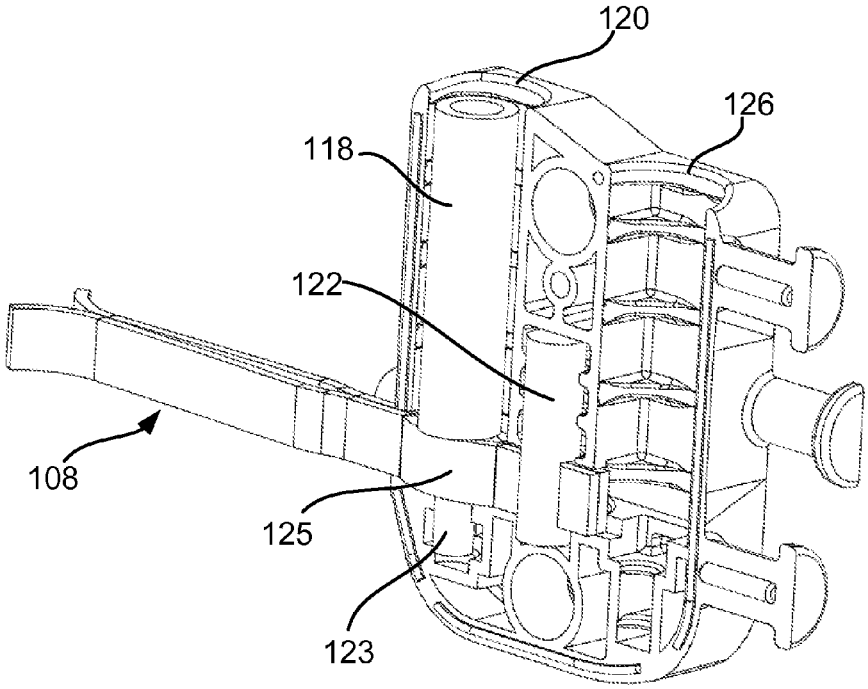
FIG. 9 is a rear and left side elevated view of the module of FIG. 7 with half the housing removed.

With reference now to FIGS. 7-9, modules 102*a*, 102*d*, 102*h* and 102*i* are adapted to engage a vertical blade in the test switch 10. Modules 102*a*, 102*d*, 102*h* and 102*i* each include an outer housing 112. According to one embodiment, outer housing 112 is injection molded and formed in two generally symmetrical halves. Blade 108 includes two curved adjacent metallic elements 114 that form a generally V-shaped tip 116. Blade 108 extends into housing 112 wherein an electrical connector 118 is electrically connected to the blade 108. In one embodiment, the electrical connector 118 is a banana jack, adapted to receive a banana plug. As can be seen, electrical connector 118 extends perpendicular from blade 108 and is aligned with front hole 120. Electrical connector 118 receives an electrical plug (not shown), for example a banana plug, which may then be connected to meters or any other appropriate electrical equipment.

Blade 108 is securely held within the two halves of housing 112. Both the electrical connector 118 and a notched pin 122 engage blade 108 to hold it within housing 112. To that end, a portion 123 of electrical connector 118 extends between outwardly curved portions 125 of metallic elements 114 to prevent longitudinal movement of blade 108 relative to the housing 112. Blade 108 is also positioned inside a notch 124 in cylindrical pin 122 to secure blade 118 within housing 112.

Housing 112 further includes a rear hole 126 that extends into housing 112 but does not include an electrical connector. The rear hole 126 is not used in this module, and is provided only because the housing elements 112 are a common part, used in a plurality of different types of modules.

It should further be appreciated that housing 112 includes, on one side, a plurality of raised features 128 and on the opposed side, a plurality of indents 130. As can be seen in FIGS. 7 and 8, raised features 128 are sized and positioned to be received in the indents 130 on the adjacent module when the test plug assembly is assembled. As will be discussed in greater detail, this configuration improves the stability of the test plug assembly.

Figure 5:
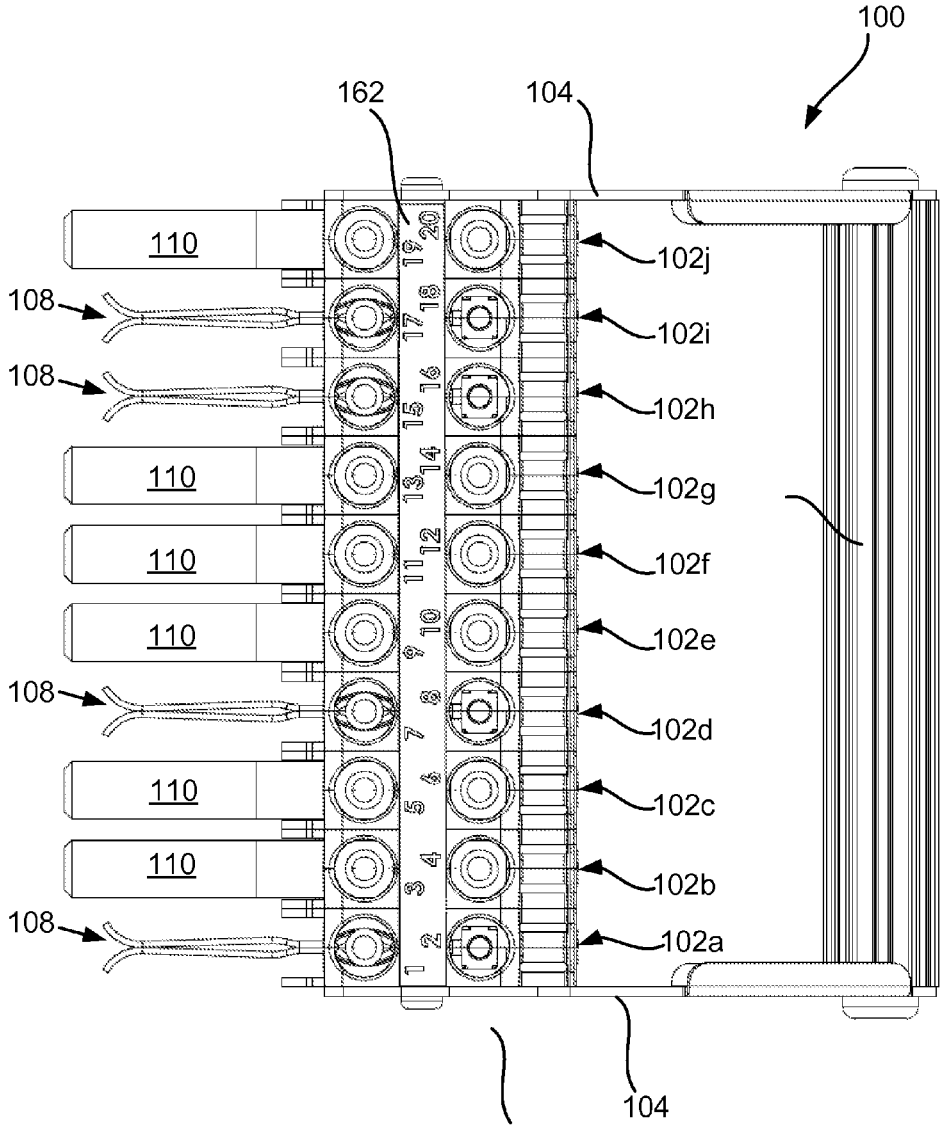
FIG. 5 is a top view of the test plug assembly.
Figure 6:
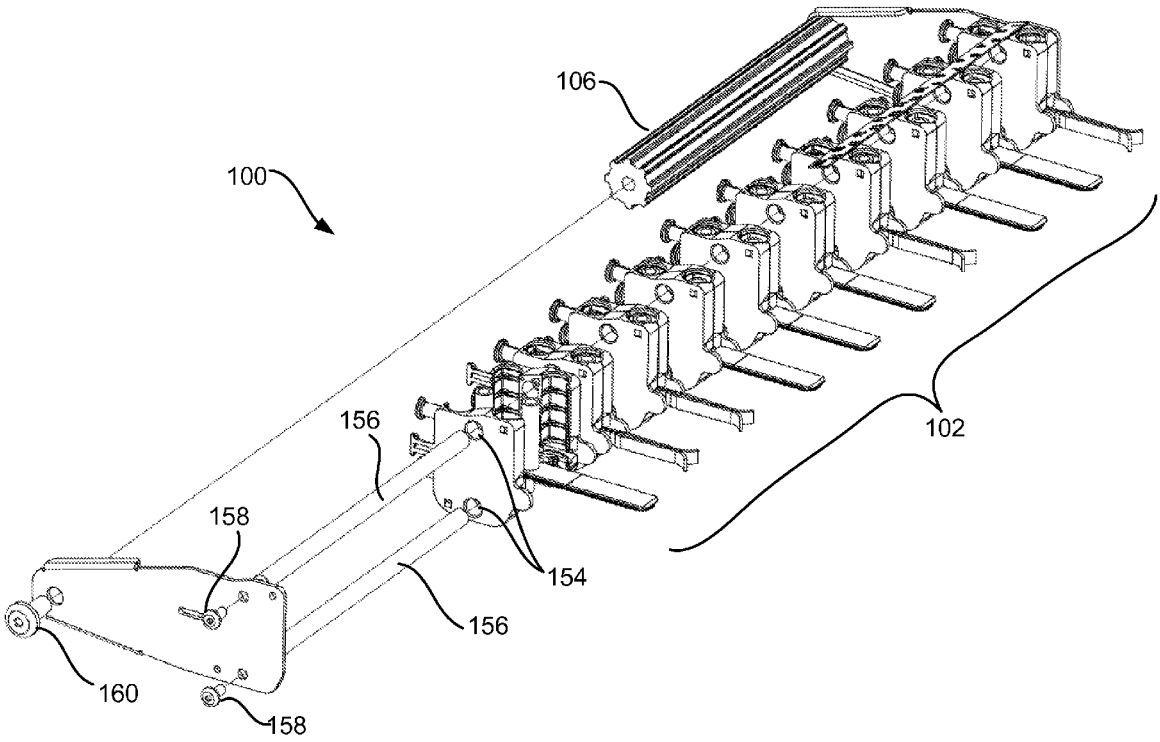
FIG. 6 is an exploded view of the test plug assembly.

Modules 102 further include a pair of cylindrical projections 132 extending outwardly from housing 112 on the side opposed from the blade 108. Each projection 132 includes a rounded flange 134. Modules 102 further include a pair of projections 136 that extend outwardly from housing 112 and are in the shape of a half-cylinder. Projections 136 include a rounded flange 138 around the curved portion of projection 136. As can be seen in FIGS. 5 and 6, projections 136 are aligned with matching projections 136 on adjacent modules 102 to form a cylindrical projection of the same shape as projections 132. Projections 132 and 136 are provided for a user to wrap or otherwise retain electrical wires that are connected to electrical connectors 118.

Figure 10:
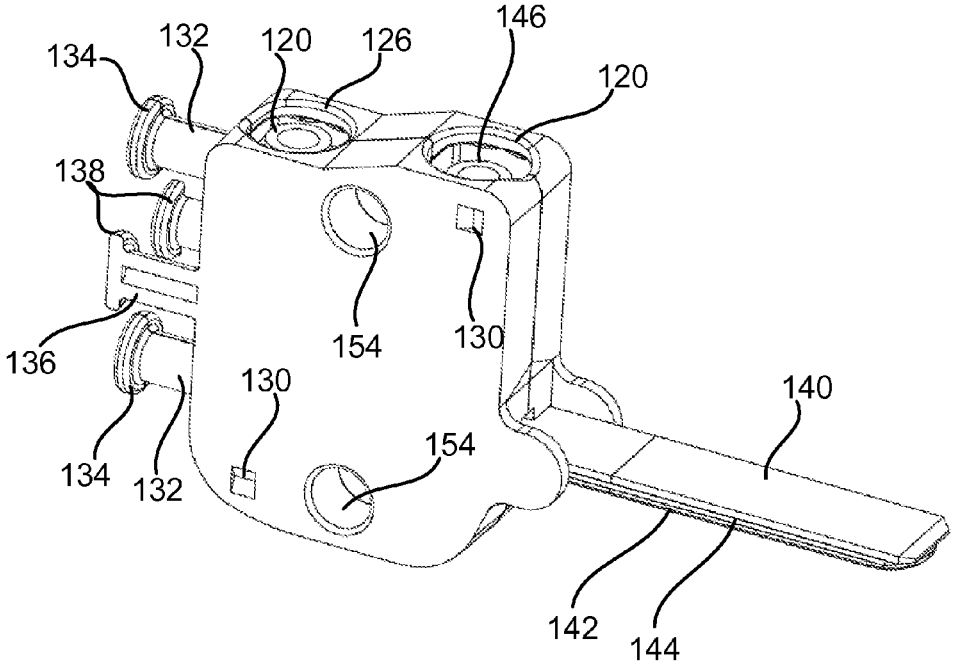
FIG. 10 is a front and right side elevated view of a second module type.
Figure 11:
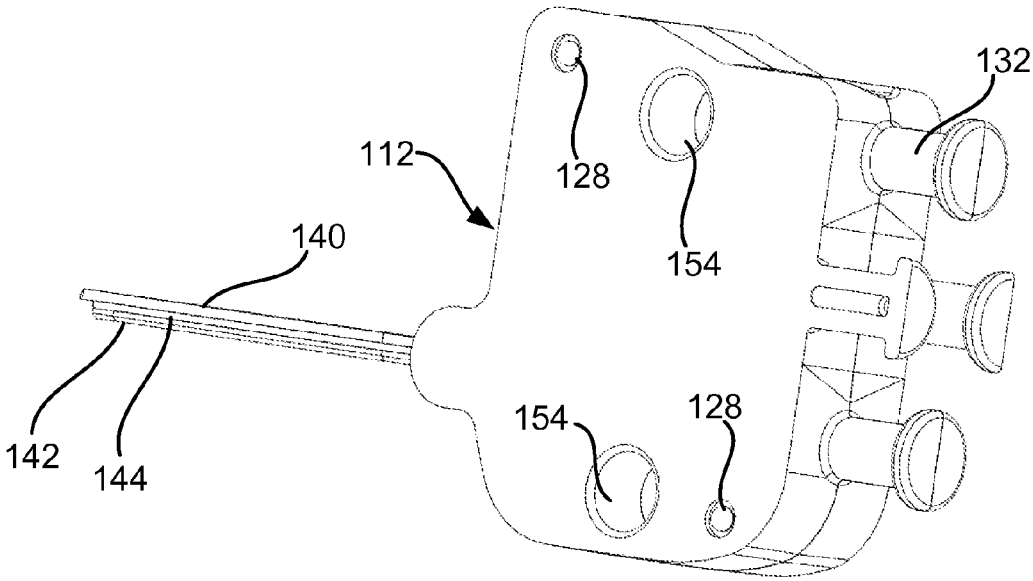
FIG. 11 is a rear and left side elevated view of the module of FIG. 10.
Figure 12:
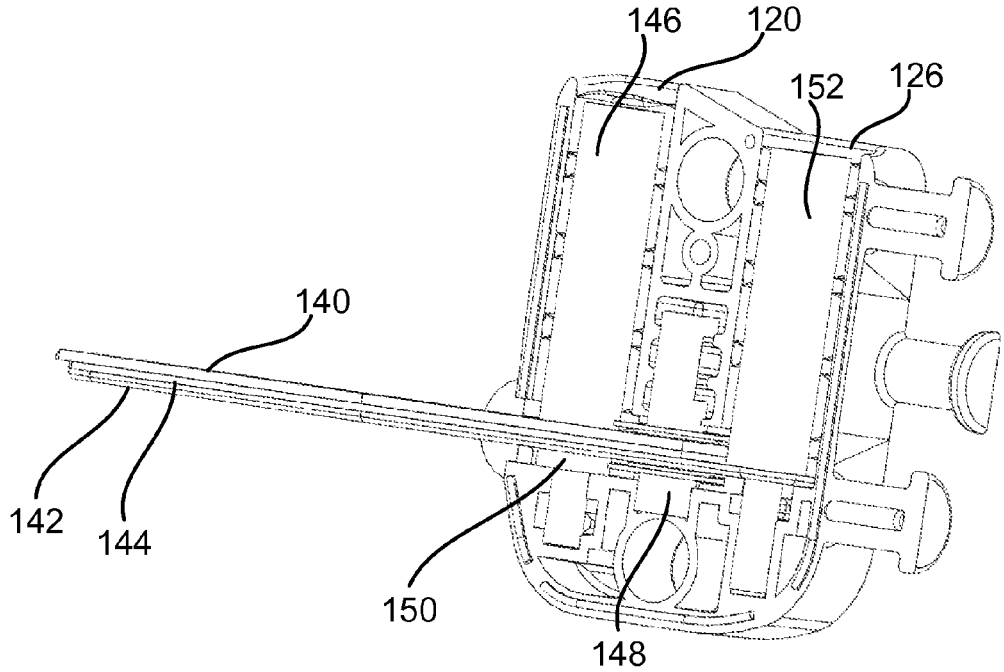
FIG. 12 is a rear and left side elevated view of the module of FIG. 10 with half the housing removed.

With reference now to FIGS. 10-12, the modules 102*b*, 102*c*, 102*e*, 102*f*, 102*g* and 102*j* are adapted to engage a current jack 16 in test switch 10. Modules 102*b*, 102*c*, 102*e*, 102*f*, 102*g* and 102*j* are substantially similar to modules 102*a*, 102*d*, 102*h* and 102*i* discussed above, with the exception that the blade 110 and inner electrical connections differ in the manner described below. Like numbers indicate like elements. Blade 110 is a three piece composite element having a first conductor element 140 and a second conductor element 142. Conductor elements 140 and 142 are spaced and electrically insulated from each other by an insulative strip 144 positioned therebetween.

Blade 110 extends into housing 112 wherein an electrical connector 146 is electrically connected to the first conductor element 140. In the embodiment of FIGS. 10-12, electrical connector 146 extends through both the first and second electrical elements 140 and 142. However, second electrical element 142 is electrically insulated from electrical connector 146 by an insulator 150. In one embodiment, the electrical connector 146 is a banana jack, adapted to receive a banana plug (not shown). As can be seen, electrical connector 146 extends perpendicular from blade 110 and is aligned with front hole 120. Electrical connector 146 receives an electrical plug, for example a banana plug which may then be connected to meters or any other appropriate electrical equipment.

Blade 110 is further held within housing 112 by a pin 148 which extends through blade 110 to prevent longitudinal movement relative to the housing 112. Pin 148 is secured between the two halves of housing 112. In this manner, blade 110 is secured within housing 112, however, it should be appreciated that pin 148 does not provide an electrical pathway between the first and second conductor elements 140 and 142.

The second electrical element 142 extends rearwardly further than first electrical element 140. An electrical connector 152 is electrically connected to the second electrical element 142. As shown in the embodiment of FIGS. 10-12, electrical connector 152 extends through and is electrically connected to second electrical element 142. In one embodiment, the electrical connector 152 is a banana jack, adapted to receive a banana plug (not shown). As can be seen, electrical connector 152 extends perpendicular from blade 110 and is aligned with rear hole 126. Electrical connector 152 receives an electrical plug, for example a banana plug which may then be connected to meters or any other appropriate electrical equipment.

Modules 102*b*, 102*c*, 102*e*, 102*f*, 102*g* and 102*j* include the same exterior features as potential modules, including raised features 128 with matching indents 130, and projections 132 and 136 having flanges 134 and 138.

All modules 102 further includes a pair of thru-holes 154 that extend through housing 112 in a direction perpendicular to electrical connectors 118, 146 and 152. As can be seen in FIG. 6, the thru-holes 154 on each module 102 is aligned with the thru hole 154 on the adjacent module so that a continuous bore is formed through the stack of modules 102. A rod 156 extends through each bore and is secured by bolts 158 to each end plate 104. In this manner, the modules 102 are secured in place between end plates 104. Further stability is achieved because the raised features 128 of each module 102 are received in matching indents 130 in each adjoining module 102.

Handle 106 is likewise secured between each end plate 104 by a pair of bolts 160. Once assembled, a numbered strip 162 may be secured over the stacked modules 102 so that each is easily identified. The test plug assembly 100 is then available for insertion into a test switch assembly.

It should be evident that test plug assembly 100 is easily reconfigured for any number of test switch configurations. In addition to the modules described above, any number of module types may be used. Further, blank spacers (i.e. just a housing with no blade) may be used depending on the associated test switch. In one embodiment, test plug assembly 100 may be used with the ABB Inc. FT family of switches. However, the present invention may be used with any electrical test switch using knife-type single pole contacts or other types with similar configuration.

Figure 13:
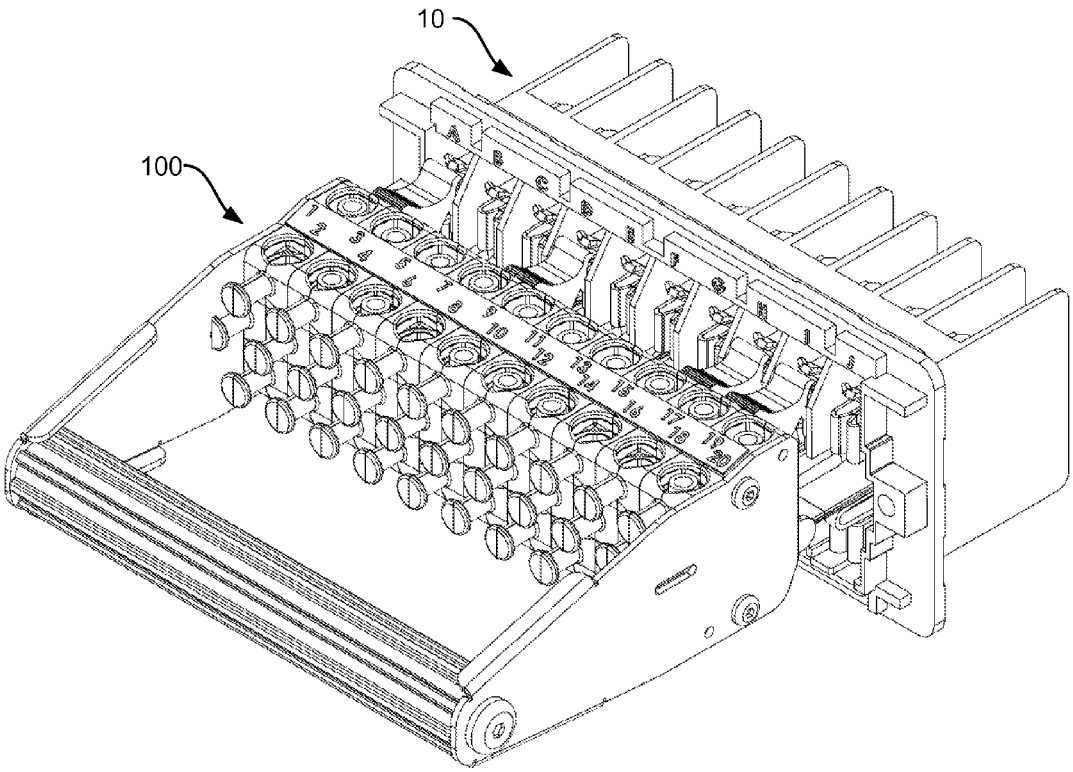
FIG. 13 is an isometric view of the test plug assembly of the present invention inserted into an exemplary prior art test switch assembly.

With reference now to FIG. 13, the test plug 100 of the present invention is shown inserted into an exemplary prior art test switch 10. As inserted, the blades 108 and 110 are brought into electrical contact with the switches. In this manner, electrical signals from the switches can be measured and monitored through the electrical connectors 118, 146, and 152.

Because each test switch assembly and corresponding test plug assembly may be tailored to a customer's exact specifications, almost limitless combinations of switch configurations are possible. The modular design of the test plug assembly 100 allows for current, potential, and/or other modules to be configured and reconfigured to exactly match any test switch arrangement. In addition, the module rear projections facilitate organization of test leads and provide a method of strain relief for the banana plug connectors should any outside force apply tension to the test wire, thus preventing accidental or inadvertent dislodgement of the test lead.

It is to be understood that the foregoing description has been provided merely for the purpose of explanation and is in no way to be construed as limiting of the invention. Where the invention has been described with reference to embodiments, it is understood that the words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

What is claimed is:

1. A test plug assembly for use with a test switch assembly connected to one or more electrical circuits, each of said electrical circuits having quantifiable characteristics when said circuit is in operation, said test switch assembly comprising one or more test switches, each of said one or more test switches associated with a respective one of said one or more electrical circuits, the test plug assembly comprising:

one or more test plug modules positioned in a stacked arrangement, each of said one or more test plug modules adaptable for in-service measurement of said quantifiable characteristics of said associated one of said one or more electrical circuits when said circuit is in operation and said test plug assembly is mated with said test switch assembly, at least one of said one or more test plug modules having an outwardly extending, electrically conductive blade for receipt in that one of said one or more test switches associated with said in operation electrical circuit whose quantifiable characteristic is to be in-service measured by said at least one test plug module when said test plug assembly is mated with said test switch assembly, said blade being electrically connected within said one or more test plug modules to a first electrical connector adapted to receive an external electrical plug, each of said one or more test plug modules further including a first thru-hole;

an end plate positioned on each end of said one or more test plug modules;

a handle spaced from said one or more test plug modules, extending between said end plates and secured thereto;

a first rod extending between said end plates and secured thereto; and wherein said first thru-hole of each of said one or more test plug modules is aligned when in the stacked arrangement, said first rod is received in said aligned first thru-holes.

2. The test plug assembly of claim 1 further comprising a second rod, wherein each of said one or more test plug modules further includes a second thru-hole, and said second-thru hole of each of said one or more test plug modules is aligned when in the stacked arrangement and said second rod is received in said aligned second thru-holes.

3. The test plug assembly of claim 1 wherein each said one or more test plug modules includes, on a first side, a plurality of detents and on a second side, opposed from said first side, includes a plurality of raised features arranged to be received in said detents of an adjacent one of said one or more test plug modules when in said stacked arrangement.

4. The test plug assembly of claim 1 wherein said at least one blade includes two curved adjacent metallic elements that form a generally V-shaped tip.

5. The test plug assembly of claim 1 wherein said at least one blade includes a first conductor element and a second conductor element, said first and second conductor elements being spaced and electrically insulated from each other by an insulative strip positioned therebetween.

6. The test plug assembly of claim 1 wherein said at least one blade is also electrically connected within one of said one or more test plug modules to a second electrical connector adapted to receive an external electrical plug.

7. The test plug assembly of claim 1 wherein each of said one or more test plug modules includes at least one cylindrical projection extending outwardly from said one or more test plug modules on the side opposed from said blade, said projection including a rounded flange.

8. The test plug assembly of claim 1 wherein each of said one or more test plug modules further includes at least one half-cylinder projection extending outwardly from said one or more test plug modules on the side opposed from said blade, each said half-cylinder projection including a rounded flange around a curved portion thereof, said half-cylinder projections being aligned with a half-cylinder projection on an adjacent one of said one or more test plug modules to form a cylindrical projection when in the stacked arrangement.

9. The test plug assembly of claim 1 wherein said electrical connector is a banana jack.

10. A test plug assembly for use with a test switch assembly connected to one or more electrical circuits, each of said electrical circuits having quantifiable characteristics when said circuit is in operation, said test switch assembly comprising one or more test switches, each of said one or more test switches associated with a respective one of said or more electrical circuits, the test plug assembly comprising:

one or more test plug modules positioned in a stacked arrangement, each of said one or more test plug modules adaptable for in-service measurement of said quantifiable characteristics of said associated one of said one or more electrical circuits when said circuit is in operation and said test plug assembly is mated with said test switch assembly, at least one of said one or more test plug modules having an outwardly extending, electrically conductive blade for receipt in that one of said one or more test switches associated with said in operation electrical circuit whose quantifiable characteristic is to be in-service measured by said at least one test plug module when said test plug assembly is mated with said test switch assembly, said blade being electrically connected within said one or more test plug modules to at least one electrical connector adapted to receive an external electrical plug;

an end plate positioned on each end of said one or more test plug modules;

a handle spaced from said one or more test plug modules, extending between said end plates and secured thereto; and wherein each said one or more test plug modules includes, on a first side, a plurality of detents and on a second side, opposed from said first side, includes a plurality of raised features arranged to be received in said detents of an adjacent one of said one or test plug modules when in said stacked arrangement.

11. The test plug assembly according to claim 10 further comprising a first rod extending between said end plates and secured thereto, and each of said one or more test plug modules further includes a first thru-hole, wherein said first thru-hole of each of said one or more test plug modules is aligned when in the stacked arrangement, and said first rod is received in said aligned first thru-holes.

12. The test plug assembly of claim 11 further comprising a second rod, wherein each of said one or more test plug modules further includes a second thru-hole, and said second-thru hole of each of said one or more test plug modules is aligned when in the stacked arrangement and said second rod is received in said aligned second thru-holes.

13. The test plug assembly of claim 10 wherein said blades are a plurality of different types and a first type of blade includes two curved adjacent metallic elements that form a generally V-shaped tip.

14. The test plug assembly of claim 13 wherein a second type of blade includes a first conductor element and a second conductor element, said first and second conductor elements being spaced and electrically insulated from each other by an insulative strip positioned therebetween.

15. The test plug assembly of claim 10 wherein at least one of said one or more test plug modules blades is also electrically connected within one of said or more test plug modules to a second electrical connector adapted to receive an external electrical plug.

16. The test plug assembly of claim 10 wherein each of said one or more test plug modules includes at least one cylindrical projection extending outwardly from said test plug module on the side opposed from said blade, said projection including a rounded flange.

17. The test plug assembly of claim 10 wherein each of said one or more test plug modules further includes at least one half-cylinder projection extending outwardly from said test plug module on the side opposed from said blade, each said half-cylinder projection including a rounded flange around a curved portion thereof, said half-cylinder projections being aligned with a half-cylinder projection on an adjacent one of said one or more test plug modules to form a cylindrical projection when in the stacked arrangement.

18. The test plug assembly of claim 10 wherein said electrical connector is a banana jack.

19. A test plug assembly for use with a test switch assembly connected to one or more electrical circuits, each of said electrical circuits having quantifiable characteristics when said circuit is in operation, said test switch assembly comprising one or more switches, each of said one or more switches associated with a respective one of said one or more electrical circuits, the test plug assembly comprising:

two plates spaced apart from each other;

a handle extending between said two plates and removably attached thereto; and a first rod spaced apart from said handle and extending between said two plates and removably attached thereto;

said test plug assembly adaptable for receiving one or more test plug modules positioned in a stacked arrangement in said test plug assembly between said two plates when said one or more test plug modules are received in said test plug assembly, each of said one or more test plug modules capable of in-service measurement of said quantifiable characteristics of said associated one of said one or more electrical circuits when said circuit is in operation and said test plug assembly with said received one or more test plug modules is mated with said test switch assembly, at least one of said one or more test plug modules having an outwardly extending, electrically conductive blade for receipt in that one of said one or more test switches associated with said in operation electrical circuit whose quantifiable characteristic is to be in-service measured by said at least one test plug module when said test plug assembly is mated with said test switch assembly, said blade being electrically connected within said at least one test plug module to a first electrical connector adapted to receive an external electrical plug, each of said one or more test plug modules further including a first thru-hole;

wherein said one or more of said test plug modules are received in said plug assembly by first removably detaching both said handle and said first rod from said two plates and then aligning said one or more test plug modules in said test plug assembly so that said first thru-hole of each of said one or more test plug modules is aligned when in the stacked arrangement so that first rod can be received in all of said aligned first thru-holes and be removably reattached to said two plates.

* * * * *